US006742438B2

(12) United States Patent
Kim

(10) Patent No.: US 6,742,438 B2
(45) Date of Patent: Jun. 1, 2004

(54) HYDRAULIC VALVE CONTROL DEVICE FOR HEAVY CONSTRUCTION EQUIPMENT

(75) Inventor: Jin Wook Kim, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 1 day.

(21) Appl. No.: 10/212,433

(22) Filed: Aug. 5, 2002

(65) Prior Publication Data

US 2003/0116010 A1 Jun. 26, 2003

(30) Foreign Application Priority Data

Dec. 20, 2001 (KR) ..... 10-2001-0081836

(51) Int. Cl.[7] ..... F15B 11/08
(52) U.S. Cl. ..... 91/445; 91/447
(58) Field of Search ..... 91/445, 447

(56) References Cited

U.S. PATENT DOCUMENTS 4,955,283 A * 9/1990 Hidaka et al. ..... 91/447
6,253,658 B1 * 7/2001 Kimura ..... 91/447
6,293,181 B1 * 9/2001 Hajek et al. ..... 91/445

* cited by examiner

*Primary Examiner*—Edward K. Look
*Assistant Examiner*—Michael Leslie
(74) *Attorney, Agent, or Firm*—Harness, Dickey & Pierce, P.L.C.

(57) ABSTRACT

An actuator is prevented from an abrupt descent by supplying a high-pressure hydraulic fluid drained upon the descent of the actuator to a path on a supply side of the actuator, provided is a main spool mounted in a path between a hydraulic pump and the actuator and controlling the drive of the actuator, a poppet mounted in a path between the main spool and the actuator and preventing the actuator from the descent, a spool mounted between a back-pressure and a feedback path of the poppet and communicating the back-pressure chamber with a path at an outlet of the main spool upon switching, and a fluid flow-reducing path communicating the back-pressure with the feedback path upon the switching of the spool and reducing hydraulic fluid drained from the actuator.

3 Claims, 5 Drawing Sheets

HYDRAULIC VALVE CONTROL DEVICE FOR HEAVY CONSTRUCTION EQUIPMENT

BACKGROUND OF THE INVENTION

1. Field of the Invention

The present invention relates to a hydraulic valve control device for heavy construction equipment, capable of leading a small amount of a high pressure hydraulic fluid drained upon descending a hydraulic actuator toward an actuator-holding spool and a main spool to prevent the actuator from being abruptly descended when the main spool is placed in neutral or switched.

2. Description of Prior Art

FIG. 1 shows main parts of a conventional hydraulic valve control device for heavy construction equipment. As shown in FIG. 1, the hydraulic valve control device for heavy construction equipment has a hydraulic pump, an actuator 15 connected to the hydraulic pump and driven upon the supplies of hydraulic fluid, a poppet 10 for opening and closing a path 12 supplying to the actuator 15 the hydraulic fluid discharged from the hydraulic pump and a path 13 communicated with the actuator 15, a back-pressure chamber 16 communicated with an orifice 11 of the poppet 10 and for storing hydraulic fluid discharged from a large chamber 15*a* of the actuator 15, and an actuator-holding spool 2 switched to the left or right direction based on an application of a pilot signal pressure Pi and for draining the hydraulic fluid of the back-pressure chamber 16 into a hydraulic pump through a variable orifice 5 communicated with a path 8.

A reference numeral 3 not described in the drawing denotes an elastic member for pressure-supporting the spool 2 and elastically biasing the closed drain port 7 in an initial state, and 9 an elastic member for pressure-supporting the poppet 10 and elastically biasing the path 12 of the main spool and the path 13 of the actuator 15 which are closed in an initial state.

The high-pressure hydraulic fluid drained from the large chamber 15*a* upon the descent of the actuator 15 is discharged into the back-pressure chamber 16 through the path 13 communicated with the large chamber 15*a* and an orifice of the poppet 10, and, at the same time, the pilot signal pressure Pi flows in the pilot port 6 to displace the spool 2 to the left direction of the drawing, so the variable orifice 5 is communicated with the drain port 7.

Accordingly, the high-pressure hydraulic fluid discharged into the back-pressure chamber 16 is drained into the hydraulic tank through the path 8, variable orifice 5, and drain port 7 in order, so that, when the actuator 15 is ascended from the ground, stopped, and descended again, a phenomenon that the actuator 15 is abruptly descended in an initial stage is developed to deteriorate its manipulations, to thereby cause a problem adding fatigue to drivers in case of performing coupling work in a state that heavy pipes are lifted.

Further, when in a neutral position of the spool 2, it is kept all the time that the high-pressure hydraulic fluid on the side of the back-pressure chamber 16 is communicated with the variable orifice 5 of the spool 2, so that the high-pressure hydraulic fluid of a neck portion of the spool 2 gets leaked through an annular gap on the left or right side. That is, a severe fluid leakage occurs through the annular gap between a cover 1 and the spool 2.

At this time, since the amount of fluid increases as the pressure increase, a leakage amount of fluid increases as a work device has more loads, so that the actuator 15 is automatically lowered toward the ground with a time lapse, to thereby cause a problem worsening the safety of heavy equipment.

FIG. 5 is a graph for showing leakages of hydraulic fluid based on the strokes of the main spool.

As shown in FIG. 5, if a switching timing of the actuator-holding spool 2 comes first compared to the opening timing of the main spool based on the opening timing of the main spool, the actuator 15 is abruptly descended by the quantity of fluid drained from the large chamber 15*a* of the actuator 15 as in "A".

In the meantime, if the actuator-holding spool 2 is opened after the opening timing of the main spool as in "B", the pressure of the back-pressure chamber 16 over the poppet 10 is transferred, as it is, over the poppet 10 due to the influence of the back pressure formed as the quantity of fluid increases.

Accordingly, the poppet 10 does not normally and smoothly move upwards, and experiences vibrations when the poppet 10 moves based on the back pressure changes, and the actuator 15 also undergoes oscillation and hunting phenomena in descent-stop-descent-stop forms when descending, to thereby cause a problem loosening driver's attention during work to increase his fatigue and worsening work efficiency.

Accordingly, problems exist in that it is difficult to design to get the opening timing of the main spool and the operation timing of the actuator-holding spool 2 coincident coincident with each other and an abstruse structure thereof worsens design drawings.

SUMMARY OF THE INVENTION

It is an object of the present invention to provide a hydraulic valve control device for heavy construction equipment, capable of enhancing the manipulations of the equipment by preventing an actuator from being abruptly descended even when a main spool remains neutral or switches through feeding back toward a main spool part of high-pressure hydraulic fluid drained when an actuator is descended.

It is another object of the present invention to provide a hydraulic valve control device for heavy construction equipment, capable of enhancing design drawings through a design regardless of the timings of the main spool and actuator-holding spool which are associated to each other with a small leakage amount of fluid through a gap between a block and the spool.

It is yet another object of the present invention to provide a hydraulic valve control device for heavy construction equipment, capable of reducing drivers' fatigue and greatly enhancing workability by enabling smooth descents of an actuator.

In order to achieve the above objects, the hydraulic valve control device for heavy construction equipment of the present invention comprises a hydraulic pump; an actuator connected to the hydraulic pump and driven upon hydraulic fluid supplies; a main spool mounted in a path between the hydraulic pump and the actuator and switched upon a pilot signal pressure to control start, stop, and direction switching of the actuator; a poppet mounted to be opened and closed at a path between the main spool and the actuator and preventing the actuator from being descended; a spool mounted between a back-pressure chamber and a feedback path of the poppet and switched upon an application of the pilot signal pressure to communicate the back-pressure chamber with a path on an outlet of the main spool; and a fluid flow-reducing path connecting the back-pressure chamber and the spool and communicating the back-pressure chamber with the feedback path upon the switching of the spool to reduce hydraulic fluid drained from the actuator.

Preferably, a diameter of the fluid flow-reducing path is formed to be relatively smaller than a diameter of the path at the outlet of the main spool.

Further, an orifice communicating the actuator with the back-pressure chamber is formed in a left and right symmetry on the poppet.

BRIEF DESCRIPTION OF THE DRAWINGS

The above object and other features of the present invention will become more apparent by describing in detail a preferred embodiment thereof with reference to the attached drawings, in which.

DETAILED DESCRIPTION OF THE PREFERRED EMBODIMENT

Hereinafter, a detailed description will be made on a hydraulic valve control device for heavy construction equipment according to a preferred embodiment of the present invention with reference to the attached drawings.

Figure 1:
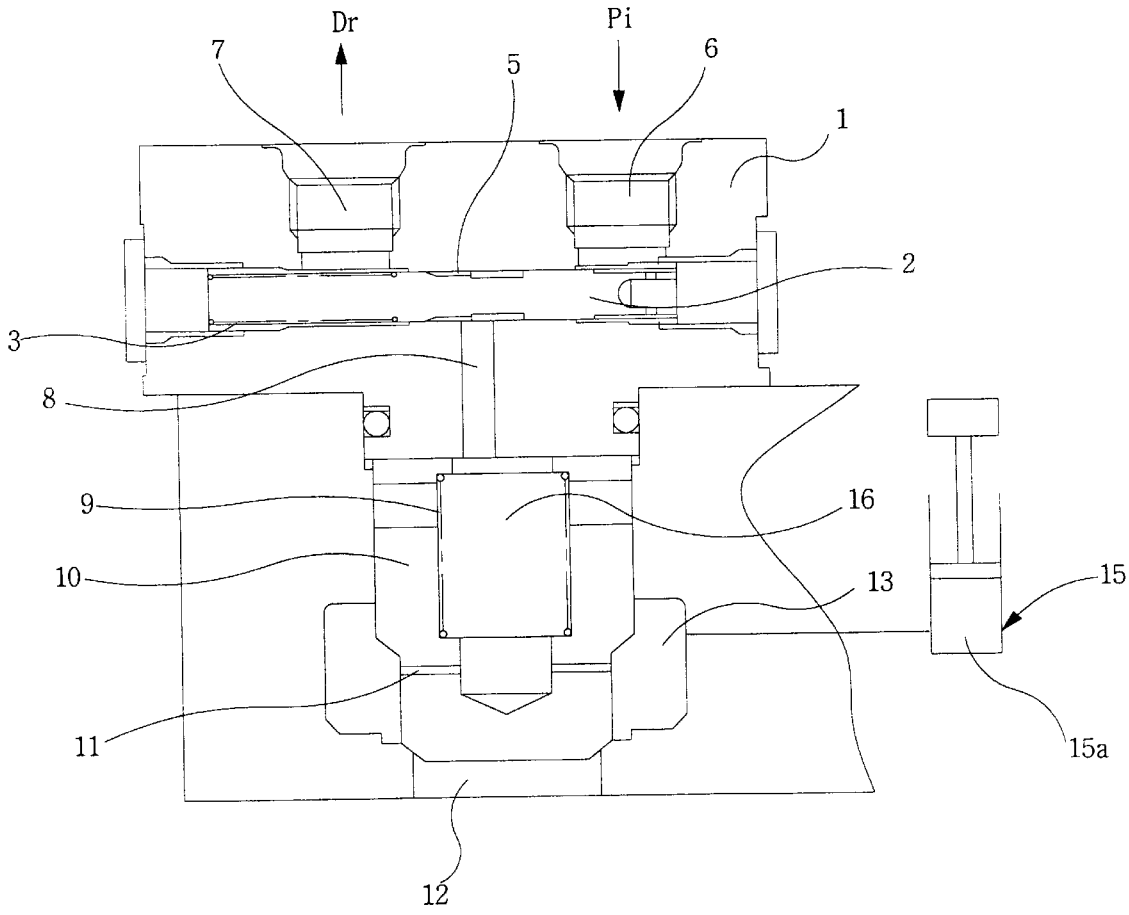
FIG.1 Prior Art
FIG. 1 is a cross-sectioned view of main parts of a conventional hydraulic valve for heavy construction equipment.
Figure 2:
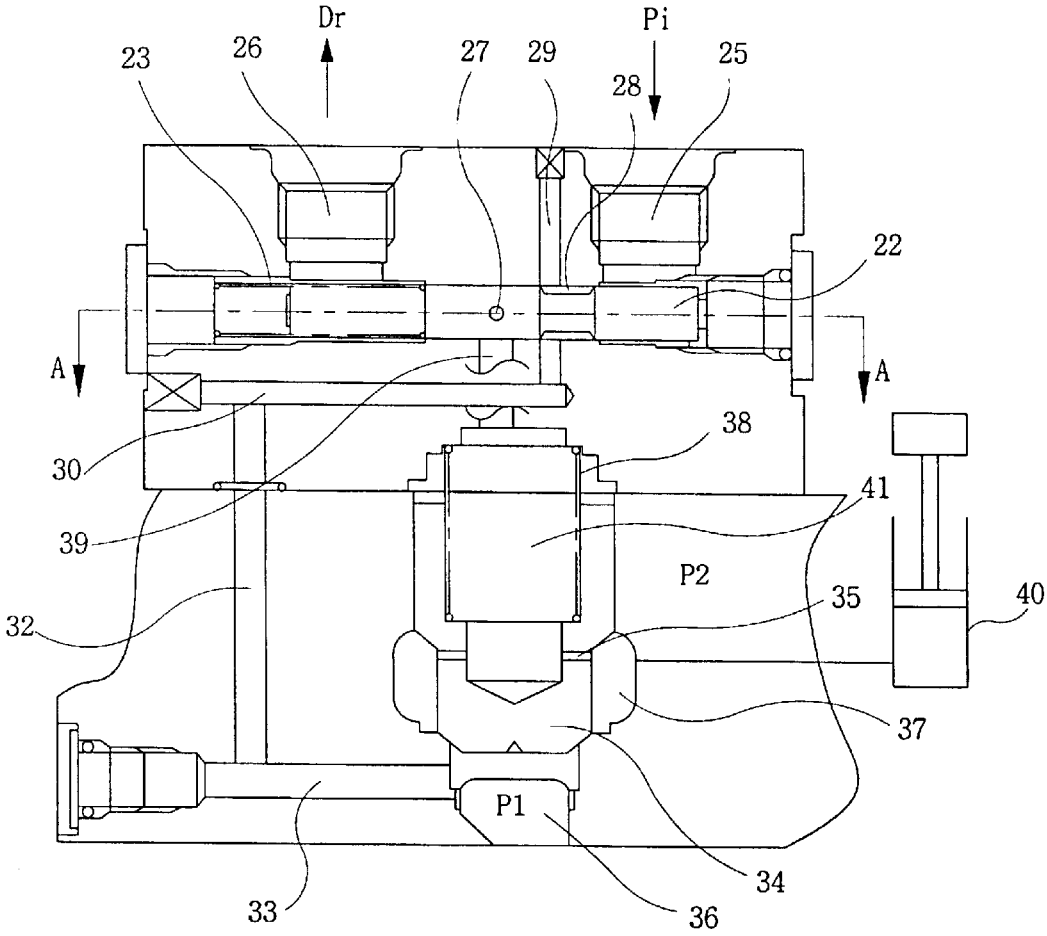
FIG. 2 is a cross-sectioned view of a hydraulic valve for heavy construction equipment according to an embodiment of the present invention.
Figure 3:
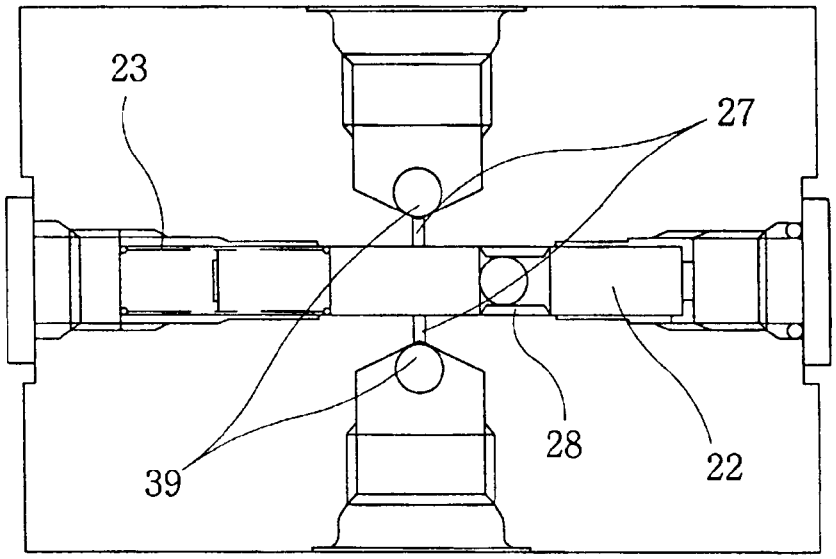
FIG. 3 is a cross-sectioned view taken along line A—A of FIG. 2.
Figure 4:
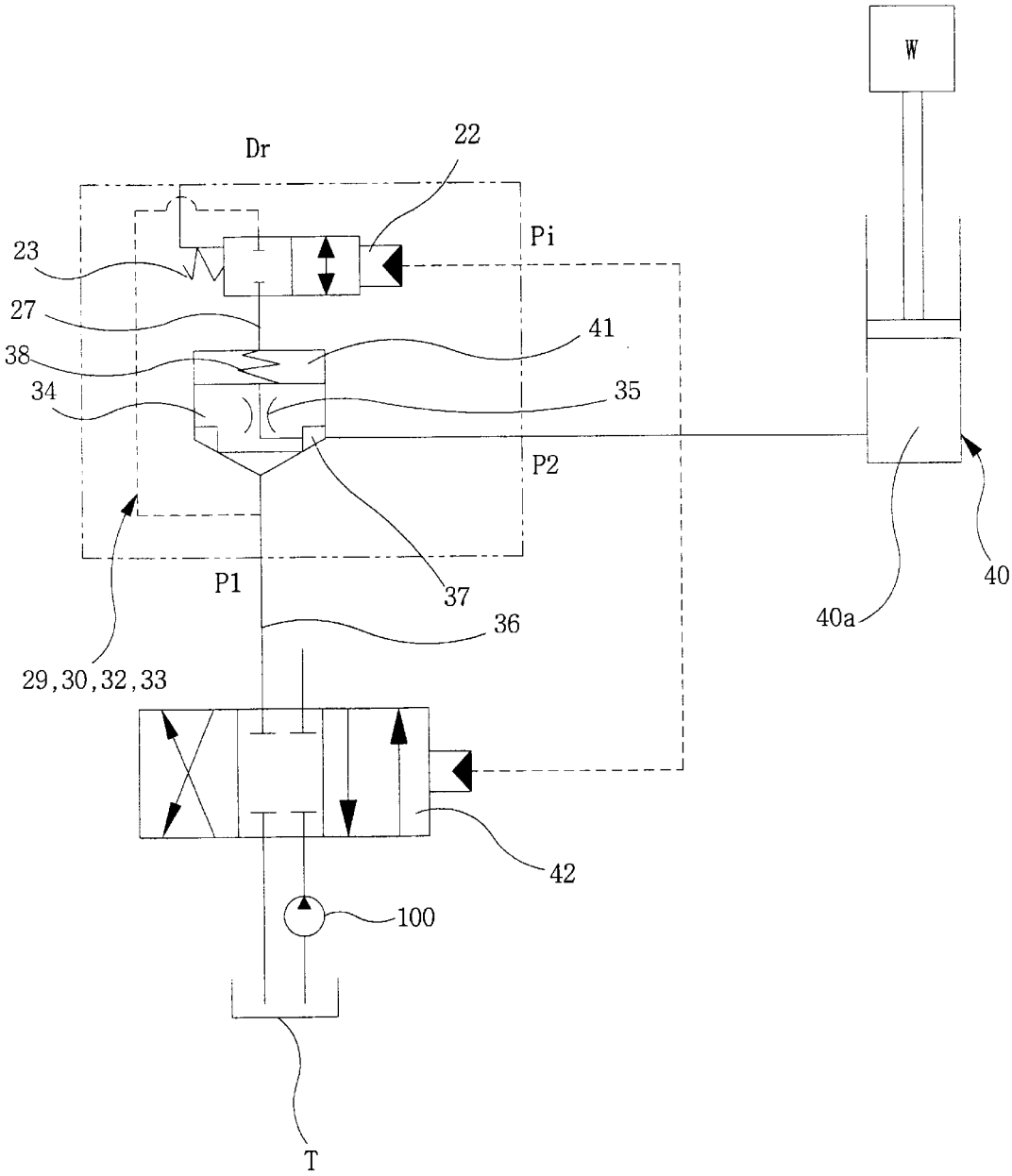
FIG. 4 is a hydraulic circuit of a hydraulic valve control device according to an embodiment of the present invention.

FIG. 2 is a cross-sectioned view of a hydraulic valve control device for heavy construction equipment according to an embodiment of the present invention, FIG. 3 is a cross-sectioned view taken along line A—A of FIG. 2, and FIG. 4 is a view for showing a hydraulic circuit of a hydraulic valve control device according to an embodiment of the present invention.

As shown in FIGS. 2 and 4, a hydraulic valve control device for heavy construction equipment has a hydraulic pump 100, an actuator 40 connected to the hydraulic pump 100 and driven upon hydraulic fluid supplies, a main spool 42 mounted in a path between the hydraulic pump 100 and the actuator 40 and switching based on a pilot signal pressure Pi, and for controlling the actuation, stop, and direction switching of the actuator 40, and a poppet 34 mounted to open and close a path between the main spool 42 and the actuator 40 and having an orifice formed in a left and right symmetry, and for preventing the actuator 40 from being descended.

Further, the hydraulic valve control device includes the main spool 42 mounted between a back-pressure chamber 41 over the poppet 34 and a feedback path and switching upon an application of the pilot signal pressure Pi to communicate the back-pressure chamber 41 with a path 36 on an outlet of the main spool 42, and a path 37 of a small diameter for reducing a fluid amount, which communicates with a path 39 connected to the back-pressure chamber 41 and drains a high-pressure hydraulic fluid of the back-pressure chamber 41 into the path 36 of the main spool 42 through the spool 22 and feedback paths 29, 30, 32, and 33 in order upon the switching of the spool 22.

A reference numeral 23 not described denotes a valve spring pressure-supporting the spool 22 and for elastically biasing in an initial state the closed path on the back-pressure chamber 41 and the main spool 42, 38 a valve spring pressure-supporting the poppet 34 and for elastically biasing in an initial state the closed path on the main spool 42 and the actuator 40.

Hereinafter, the operations of the hydraulic valve control device for heavy construction equipment according to a preferred embodiment of the present invention with reference to the attached drawings.

As shown in FIGS. 2 and 4, as the pilot signal pressure Pi flows in through the pilot port 25 and overcome the elastic force of the valve spring 23 to switch the spool 22 to the left direction of the drawing of FIG. 2, the path of a small diameter which may be an infinitesimal diameter and a neck portion of the spool are communicated, so a high-pressure hydraulic fluid in the back-pressure chamber 41 passes the paths 39 and 27, the neck portion 28 of the spool, and feedback paths 29, 30, 32, and 33 in order and then moves to a path 36 between the poppet 34 and the main spool 42.

Further, the pilot signal pressure Pi is applied to the right end of the main spool 42 and, accordingly, the main spool 42 is simultaneously switched to the left direction of the drawing of FIG. 4, so that the hydraulic fluid drained along the path 36 is drained into the hydraulic tank via the main spool 42 displaced, dropping the pressure of the back-pressure chamber 41 to a low pressure.

Accordingly, the high-pressure hydraulic fluid in the path 37 communicated with a large chamber 40*a* of the actuator 40 overcomes the elastic force of the valve spring 38 pressure-supporting the poppet 34 and moves the poppet 34 upwards on the drawing of FIG. 2, so the actuator 40 gradually descends due to the communication with the path 36 at the outlet of the main spool 42.

At this time, since the amount of fluid drained when the actuator 40 descends is removed through the minute path 27 before the poppet 34 moves upwards, the leakage amount of fluid is remarkably reduced, to thereby prevent the actuator 40 from being abruptly descended.

That is, the amount of flow drained $Q=Cd\times A\times\sqrt{\Delta P}$ (Here, Cd: flow coefficient, A: cross-sectional area for fluid flow, ΔP: pressure loss)

As above, the amount of flow of fluid leaked(Q) is proportional to the cross-sectional area(A) or the load pressure(P), so the amount of flow(Q) increases as the load pressure(P) becomes higher or the cross-sectional area(A) in which the hydraulic fluid passes increases.

Figure 5:
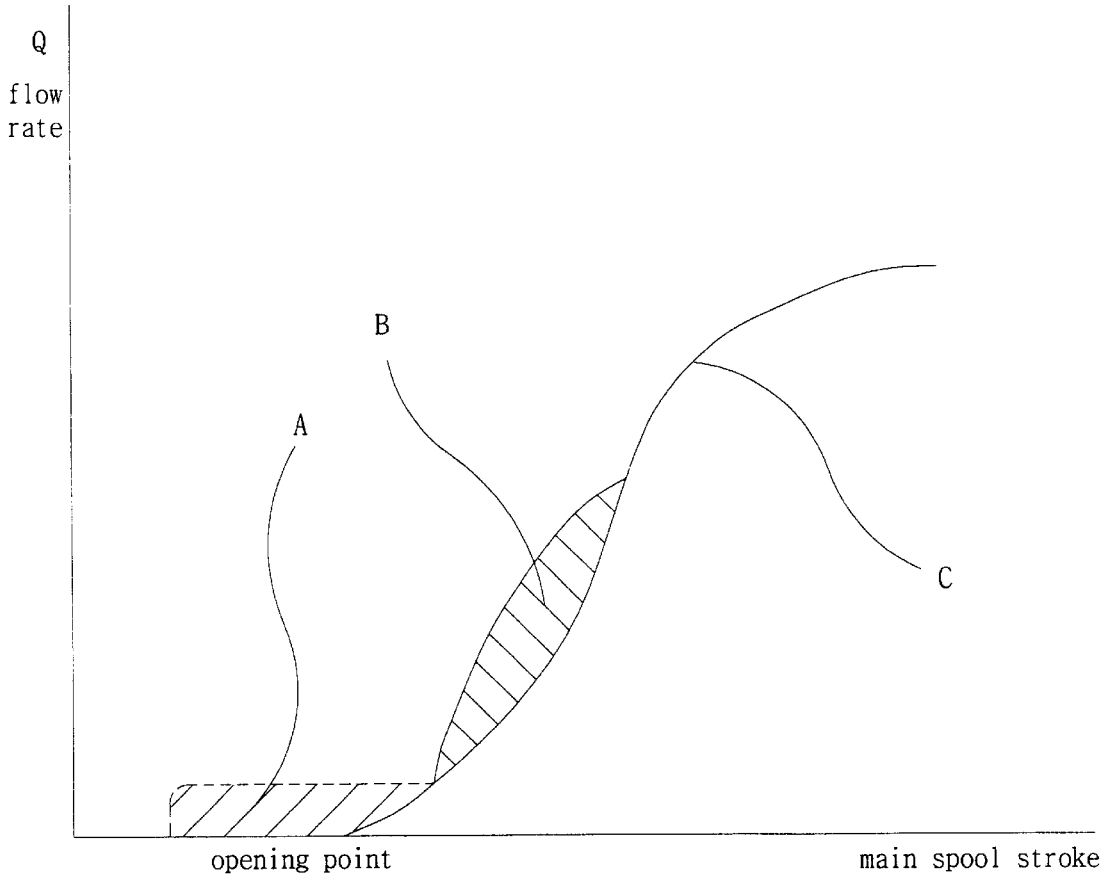
FIG.5 Prior Art
FIG. 5 is a graph for showing fluid leakages occurring with the strokes of a main spool.

Accordingly, the high-pressure hydraulic fluid drained upon the descent of the actuator 40 is fed back toward the main spool 42 through the small path 27 regardless of the opening timing of the main spool 42(refer to "C" in FIG. 5), so the actuator 40 is prevented from the abrupt descent when in the neutral state or the switching of the main spool 42 to enhance the manipulation of the equipment, to thereby enhance the workability.

Further, the reduction of fluid leakage through the gap between the block and the spool 22 enables the associated switching timings of the main spool 42 and the actuator-holding spool 22 to be designed regardless of the fluid leakage, so the design drawings are enhanced and the smooth descent of the actuator 40 is enabled to enhance the concentration of drivers as well as to reduce drivers' fatigue, thereby enhancing workability.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

The entire disclosure of Korean Patent Application No. 2001-0081836 filed Dec. 20, 2001 is hereby incorporated by reference.

What is claimed is:

1. A hydraulic valve control device for heavy construction equipment, comprising:

a hydraulic pump;

an actuator connected to the hydraulic pump and driven upon hydraulic fluid supplies;

a main spool mounted in a path between the hydraulic pump and the actuator and switched upon a pilot signal pressure to control start, stop, and direction switching of the actuator;

a poppet mounted to be opened and closed at a path between the main spool and the actuator and preventing the actuator from being descended;

a spool mounted between a back-pressure chamber and a feedback path of the poppet and switched upon an application of the pilot signal pressure to communicate the back-pressure chamber with a path on an outlet of the main spool; said spool having a minute through hole orifice defining a fluid flow-reducing path connecting the back-pressure chamber and the spool and communicating the back-pressure chamber with the feedback path upon the switching of the spool to reduce hydraulic fluid drained from the actuator.

2. The hydraulic valve control device as claimed in claim 1, wherein a diameter of the fluid flow-reducing path is formed to be relatively smaller than a diameter of the path at the outlet of the main spool.

3. The hydraulic valve control device as claimed in claim 1, wherein an orifice communicating the actuator with the back-pressure chamber is formed in a left and right symmetry on the poppet.

* * * * *